US006060120A

United States Patent [19]

Griebl et al.

[11] Patent Number: 6,060,120

[45] Date of Patent: May 9, 2000

[54] PROCEDURE FOR TRANSFERRING LASER COPY IMAGES ONTO TEXTILES USING A SPRAY BASED TEXTILE FIXING AGENT

[76] Inventors: Hans-Jurgen Griebl; Maria Josefina Herminia Baggen, both of San Barolomé, 5, 03560 El Campello (Alicante), Spain

[21] Appl. No.: 08/902,195

[22] Filed: Jul. 29, 1997

Related U.S. Application Data

[63] Continuation-in-part of application No. 08/506,765, Jul. 26, 1995, abandoned.

[30] Foreign Application Priority Data

Feb. 13, 1995 [ES] Spain ..... 9500281

[51] Int. Cl.[7] ..... B05D 1/02; B05D 1/28; B05D 3/10

[52] U.S. Cl. ..... 427/258; 427/288; 427/336; 427/370; 427/421

[58] Field of Search ..... 427/258, 288, 427/336, 337, 370, 375, 385.5, 421, 340, 342, 389.9; 156/236; 101/487, 492, 493

[56] References Cited

U.S. PATENT DOCUMENTS 5,073,218 12/1991 Aggio ..... 156/230

FOREIGN PATENT DOCUMENTS 2906 219 2/1979 Germany .

*Primary Examiner*—Fred J. Parker
*Attorney, Agent, or Firm*—Bacon & Thomas

[57] ABSTRACT

The present invention consists in obtaining a photocopy in a normal copy paper. After that, a spray that contains a textile fixing component is applied upon the paper absorbing the toner of the copy, and the copy impregnated with the textile fixing fluid is placed upon the fabric with the aid of heating and pressing means.

5 Claims, No Drawings

PROCEDURE FOR TRANSFERRING LASER COPY IMAGES ONTO TEXTILES USING A SPRAY BASED TEXTILE FIXING AGENT

This application is a continuation-in-part of application Ser. No. 08/506,765, filed Jul. 26, 1995, now abandoned.

DESCRIPTION

OBJECT OF THE INVENTION

The object of this specification relates to a ingenious usage of a textile fixing base in a textile stamping procedure, allowing the use of laser photocopies made upon normal photocopy paper.

It incorporates the treatment of the copy obtained through the previously mentioned liquid spray, in fact a textile fixing base, generating with it a original image transfer, from the copy to the fabric.

With his procedure the fixing base absorbs the toner and the liquid thus impregnated is then ready for its transfer, thermally and through pressure, upon any type of textile materials, whether natural or synthetic.

BACKGROUND OF THE INVENTION

Only one procedure is known for the stamping of textile materials from photocopies, which consists of using a transfer paper, previously chemically treated, before passing it through the conventional photocopier.

This special transfer paper, once photocopied, is then dry stamped, in the color photocopier and upon the fabrics selected.

This procedure does still feature a number of inconveniences for its practical use, such as:

The damage caused in the copier due to the continuous use of chemically treated paper.

Fabric stamping is very superficially effected, and therefore resistance of the transferred image to consecutive garment washing is very low.

The selectivity of the procedure, given that the stamping may not be effected upon all kind of materials.

The high cost of the chemically treated paper.

Up to date there is no knowledge of any type of procedure allowing image transfer upon all kinds of textile material, inexpensive, such as that using normal photocopier paper and effecting fluid based stamping, so that it penetrates deeply into the fabric, thus facilitating transfer maintenance over consecutive washing.

DESCRIPTION OF THE INVENTION

The solution advanced herewith consists of a textile stamping procedure, using normal photocopier paper, incorporating the treatment of the copy so obtained through a liquid spray, generating a stamping transfer procedure, from the copy to the fabric.

To this end normal photocopier paper is placed into a laser photocopier, obtaining a color copy.

Then, upon this color copy is applied, using a spray, a textile fixing base, which absorbs the toner off the copy.

In the third operation the copy, already impregnated with the fixing base fluid, is then placed upon any light colored fabric, proceeding then to stamp the illustration, signs or marks from the paper on to the fabric through the use of a clothes iron, manual, pneumatic or hydraulic, previously heated to a temperature of approximately 200° C. The fabrics to be stamped may be of any type, either natural (cotton, silk, wool, etc.) or synthetic.

The toner absorbed by the spray is then passed on to the fabric, deeply penetrating therein, which shall then offer a high degree of resistance to the successive washing of the garment to be made with this stamping, directly related to the resistance to washing of the fixing base chemical product.

The paper placed upon the fabric is then removed.

In order to complement the description given and so as to facilitate a better and easier comprehension of the characteristics of the invention, this patent specification is accompanied, as integral part thereof, of a diagram in which with a merely illustrative but never limitative character the following has been represented:

The diagram shows in a graphical and schematic manner the stamping procedure following by this invention.

PREFERRED EXECUTION OF THE INVENTION

The invention here advanced consists of a textile stamping procedure, using normal photocopier paper, whence the copy so obtained is treated with a spray based fluid textile fixing base, generating a copy to fabric stamping transfer procedure.

A colour copy is obtained by using a normal photocopier paper, in a laser photocopier, is upon which is applied, using a spray, a textile fixing base that absorbs the toner, being of the photocopy placing the sprayed photocopy upon any kind of light colored fabric, proceeding then to stamp the treated photocopy or upon the fabric through the use of a, manual, pneumatic or hydraulic clothes iron (5), heated up to a temperature of approximately 200° C., transferring the toner absorbed by the spray to the textile, penetrating it deeply into the fabric, to provide a high level of resistance to successive washing, as a function of the resistance to washing of the own fixer fluid, then withdrawning the copy paper previously placed upon the fabric.

This description needs not be extended any further as any expert in this art would already have enough information to understand the scope of the invention and the advantages derived from it, as well as to be able to reproduce it.

It is further understood that, as long as the essential qualities of the invention is not altered, its materials and shape, size and arrangement of the elements may be varied within the same characteristics.

The terms used during the description, as well as their sense must at all times be considered in a non limitative manner.

Two possible compositions of the textile fixing base are as follows:

The "textile fixing base" can be obtained with two different compositions (% is weight percent).

First Compound (Textile Fixing Base)

| | |
|---|---|
| Acrylic based dispersion | 20%–30% |
| Water | 10%–20% |
| Propylene glycol ester | 10%–25% |
| Tertiary amines | <1% |
| Acrylic thickener | <2% |
| Succinate di ester | 5%–10% |
| Adipate di ester | 5%–10% |
| Glutarate di ester | 5%–10% |

Second Compound (Textile Fixing Base)

| | |
|---|---|
| Acrylic based dispersion | 10%–25% |
| Water | 20%–35% |
| Propylene glycol ester | 10%–25% |
| Alkyl di ester | 10%–25% |
| Tertiary amines | <1% |
| Acrylic thickener | <2% |

We claim:

1. A process for transferring a laser copy image on a plain copy paper base onto a textile substrate using a spray-based textile fixing agent, comprising the steps of forming an image on a plain copy paper base in a laser photocopier, spraying the spray-based textile fixing agent onto the laser copy image, placing the sprayed copy image on a colored textile substrate, stamping the laser copy image upon the textile substrate with a manual, pneumatic or hydraulic clothes iron heated to a temperature of approximately 200° C., to transfer the image absorbed by the spray to the textile substrate which penetrates the textile substrate to form a transferred image on the textile substrate which is resistant to washing, and removing the copy paper base placed upon the textile substrate.

2. A process for transferring a laser copy image onto a textile substrate using a spray-based textile fixing agent according to claim 1 wherein the clothes iron is a pneumatic iron.

3. A process for transferring a laser copy image onto a textile substrate using a spray-based textile fixing agent according to claim 1 wherein the clothes iron is a hydraulic iron.

4. A process for transferring a laser copy image onto a textile substrate of claim 1, wherein the spray-based textile fixing agent comprises, in weight percent:

| | |
|---|---|
| Acrylic based dispersion | 20%–30% |
| Water | 10%–20% |
| Propylene glycol ester | 10%–25% |
| Tertiary amines | <1% |
| Acrylic thickener | <2% |
| Succinate di ester | 5%–10% |
| Adipate di ester | 5%–10% |
| Glutarate di ester | 5%–10%. |

5. A process for transferring a laser copy image onto a textile substrate of claim 1, wherein the spray-based textile fixing agent comprises in weight percent:

| | |
|---|---|
| Acrylic based dispersion | 10%–25% |
| Water | 20%–35% |
| Propylene glycol ester | 10%–25% |
| Alkyl di ester | 10%–25% |
| Tertiary amines | <1% |
| Acrylic thickener | <2%. |

* * * * *